US010653209B2

(12) United States Patent
Pratt et al.

(10) Patent No.: US 10,653,209 B2
(45) Date of Patent: May 19, 2020

(54) RAPID-ENTRY FOOTWEAR HAVING AN ACTUATOR ARM

(71) Applicant: FAST IP, LLC, Alpine, UT (US)

(72) Inventors: Michael Pratt, Alpine, UT (US); Steven Hermann, Saratoga Springs, UT (US); Seth Lytle, Pleasant Grove, UT (US); Craig Cheney, Orem, UT (US)

(73) Assignee: FAST IP, LLC, Vineyard, UT (US)

( * ) Notice: Subject to any disclaimer, the term of this patent is extended or adjusted under 35 U.S.C. 154(b) by 0 days.

(21) Appl. No.: 16/457,406

(22) Filed: Jun. 28, 2019

(65) Prior Publication Data

US 2020/0000178 A1 Jan. 2, 2020

Related U.S. Application Data

(60) Provisional application No. 62/755,123, filed on Nov. 2, 2018, provisional application No. 62/691,201, filed on Jun. 28, 2018.

(51) Int. Cl.

| | |
|---|---|
| ***A43C 11/14*** | (2006.01) |
| ***A43B 3/24*** | (2006.01) |
| ***A43C 11/00*** | (2006.01) |
| ***A43B 23/02*** | (2006.01) |
| ***A43B 21/32*** | (2006.01) |
| *A43C 11/20* | (2006.01) |

(52) U.S. Cl.

CPC ..... *A43C 11/14* (2013.01); *A43B 3/242* (2013.01); *A43B 21/32* (2013.01); *A43B 23/027* (2013.01); *A43C 11/004* (2013.01); *A43C 11/008* (2013.01); *A43C 11/20* (2013.01)

(58) Field of Classification Search

CPC ..... A43B 3/242; A43B 23/027; A43B 21/32; A43C 11/14; A43C 11/004; A43C 11/008; A43C 11/20

USPC ..... 36/50.5, 138, 105

See application file for complete search history.

(56) References Cited

U.S. PATENT DOCUMENTS

| | | | |
|---|---|---|---|
| 112,439 | A | 3/1871 | Francis |
| 808,948 | A | 1/1906 | Roberts et al. |
| 827,330 | A | 7/1906 | Tillson |
| 863,549 | A | 8/1907 | Metz |
| 881,153 | A | 3/1908 | Rickert |
| 923,860 | A | 6/1909 | Kroell |
| 921,461 | A | 9/1909 | Rickert |

(Continued)

FOREIGN PATENT DOCUMENTS

| | | |
|---|---|---|
| CN | 2438353 | 7/2001 |
| CN | 1403041 | 3/2003 |

(Continued)

OTHER PUBLICATIONS

USPTO; Non-Final Office Action dated Mar. 6, 2019 in U.S. Appl. No. 15/690,679.

(Continued)

*Primary Examiner* — Ted Kavanaugh

(57) ABSTRACT

A rapid-entry shoe includes an actuator arm, having a pivot point, and a closure system. Movement of the actuator arm from an uncollapsed position to a collapsed position opens the closure system and movement of the actuator arm from the collapsed position to the uncollapsed position closes the closure system, according to various embodiments.

10 Claims, 12 Drawing Sheets

(56) References Cited

U.S. PATENT DOCUMENTS

| | | | | |
|---|---|---|---|---|
| 1,081,678 | A | 12/1913 | Langerak | |
| 1,116,462 | A | 11/1914 | Moran | |
| 1,464,342 | A | 8/1923 | Rothacher | |
| 1,494,236 | A | 5/1924 | Greathouse | |
| 1,686,175 | A | 10/1928 | Read | |
| 1,926,818 | A | 9/1933 | Ratcliff | |
| 2,069,752 | A | 8/1935 | Dorr | |
| 2,266,732 | A | 4/1940 | Babinchak | |
| 2,368,514 | A | 1/1945 | Baehr | |
| 2,450,250 | A | 3/1945 | Napton | |
| 2,452,502 | A | 4/1945 | Tarbox | |
| 2,829,448 | A | 11/1954 | Minera | |
| 2,736,110 | A | 2/1956 | Hardimon | |
| 2,763,071 | A | 9/1956 | Kingsley | |
| 2,920,402 | A | 1/1960 | Minera | |
| 3,000,116 | A | 9/1961 | Ally | |
| 3,146,535 | A | 9/1964 | Owings | |
| 4,489,509 | A | 12/1984 | Libit | |
| 4,590,690 | A | 5/1986 | Pfander | |
| 4,596,080 | A * | 6/1986 | Benoit | A43B 5/048 36/118.9 |
| 4,811,502 | A | 3/1989 | Barret | |
| 4,924,605 | A | 5/1990 | Spademan | |
| 4,972,613 | A | 11/1990 | Loveder | |
| 5,054,216 | A | 10/1991 | Lin | |
| 5,127,170 | A | 7/1992 | Messina | |
| 5,181,331 | A | 1/1993 | Berger | |
| 5,184,410 | A | 2/1993 | Hamilton | |
| 5,282,327 | A | 2/1994 | Ogle | |
| 5,341,583 | A | 8/1994 | Hallenbeck | |
| 5,371,957 | A | 12/1994 | Gaudio | |
| 5,467,537 | A | 11/1995 | Aveni et al. | |
| 5,481,814 | A | 1/1996 | Spencer | |
| 5,842,292 | A | 12/1998 | Siesel | |
| 5,983,530 | A * | 11/1999 | Chou | A43C 1/04 36/118.1 |
| 5,997,027 | A * | 12/1999 | Jungkind | A63C 10/045 280/14.21 |
| 6,125,555 | A | 10/2000 | Schenkel | |
| 6,189,239 | B1 | 2/2001 | Gasparovic et al. | |
| 6,360,454 | B1 | 3/2002 | Dachgruber | |
| 6,378,230 | B1 | 4/2002 | Rotem et al. | |
| 6,470,537 | B1 * | 10/2002 | Schallenkamp | A43C 11/14 24/69 SK |
| 6,643,954 | B2 * | 11/2003 | Voswinkel | A43B 11/00 36/138 |
| 6,671,980 | B1 | 1/2004 | Liu | |
| 6,684,533 | B1 | 2/2004 | Su | |
| 6,922,917 | B2 | 8/2005 | Kerns | |
| 6,938,361 | B2 | 9/2005 | Su | |
| 7,103,994 | B2 | 9/2006 | Johnson | |
| 7,178,270 | B2 | 2/2007 | Hurd et al. | |
| 7,225,563 | B2 | 6/2007 | Chen | |
| 7,439,837 | B2 | 10/2008 | McDonald | |
| 7,661,205 | B2 | 2/2010 | Johnson | |
| 7,685,747 | B1 | 3/2010 | Gasparovic et al. | |
| 7,793,438 | B1 | 9/2010 | Busse et al. | |
| 7,823,299 | B1 | 11/2010 | Brigham | |
| 7,975,403 | B2 | 7/2011 | Mosher | |
| D648,512 | S | 11/2011 | Schlageter | |
| 8,065,819 | B2 | 11/2011 | Kaufman | |
| 8,087,188 | B2 * | 1/2012 | Labbe | A43B 11/00 24/712 |
| 8,161,669 | B2 | 4/2012 | Keating | |
| 8,225,535 | B2 | 7/2012 | Dillenbeck | |
| 8,499,474 | B2 | 8/2013 | Kaufman | |
| 8,769,845 | B2 | 7/2014 | Lin | |
| 9,615,624 | B2 | 4/2017 | Kilgore et al. | |
| 9,675,132 | B2 | 6/2017 | Marshall | |
| 9,820,527 | B2 | 11/2017 | Pratt et al. | |
| 9,877,542 | B2 | 1/2018 | Pratt | |
| 10,306,947 | B2 | 6/2019 | Pratt et al. | |
| 10,455,898 | B1 | 10/2019 | Orand et al. | |
| 2002/0144434 | A1 | 10/2002 | Farys | |
| 2005/0022428 | A1 | 2/2005 | Anderson | |
| 2005/0039348 | A1 | 2/2005 | Raluy et al. | |
| 2005/0076540 | A1 | 4/2005 | Su | |
| 2005/0198867 | A1 | 9/2005 | Labbe | |
| 2007/0074425 | A1 | 4/2007 | Leong | |
| 2008/0086911 | A1 | 4/2008 | Labbe | |
| 2008/0189984 | A1 | 8/2008 | Januszewski et al. | |
| 2008/0307673 | A1 | 12/2008 | Johnson | |
| 2010/0095494 | A1 * | 4/2010 | Martin | A43B 5/14 24/70 ST |
| 2011/0016751 | A1 | 1/2011 | Somerville | |
| 2011/0146106 | A1 | 6/2011 | Kaufman | |
| 2012/0216429 | A1 | 8/2012 | Bastida et al. | |
| 2012/0317839 | A1 | 12/2012 | Pratt | |
| 2013/0185959 | A1 | 7/2013 | Coleman | |
| 2013/0219747 | A1 | 8/2013 | Lederer | |
| 2015/0305432 | A1 | 10/2015 | Wiens | |
| 2016/0374427 | A1 | 12/2016 | Zahabian | |
| 2017/0215525 | A1 * | 8/2017 | Labbe | A43B 11/00 |
| 2017/0360143 | A1 | 12/2017 | Pratt | |
| 2017/0360151 | A1 | 12/2017 | Pratt | |
| 2018/0110287 | A1 | 4/2018 | Hopkins et al. | |
| 2018/0110292 | A1 | 4/2018 | Beers et al. | |
| 2018/0199659 | A1 * | 7/2018 | Lintaman | A43C 11/146 |
| 2018/0289109 | A1 | 10/2018 | Beers et al. | |
| 2018/0295942 | A1 | 10/2018 | Drake | |

FOREIGN PATENT DOCUMENTS

| | | |
|---|---|---|
| CN | 201005111 | 1/2008 |
| DE | 19534249 | 3/1997 |
| DE | 19611797 | 10/1997 |
| DE | 29809404 | 8/1998 |
| DE | 10247163 | 10/2002 |
| DE | 102004005288 | 8/2005 |
| EP | 1059044 | 12/2000 |
| GB | 2517399 | 8/2013 |
| JP | 181910 | 6/1989 |
| JP | 2001149394 | 6/2001 |
| JP | 2006055571 | 3/2006 |
| WO | 2007080205 | 7/2007 |
| WO | 2009089572 | 7/2009 |
| WO | 2017004135 | 1/2017 |

OTHER PUBLICATIONS

USPTO; Notice of Allowance dated Apr. 10, 2019 in U.S. Appl. No. 15/690,679.

USPTO; Non-Final Office Action dated Mar. 7, 2019 in U.S. Appl. No. 15/934,740.

USPTO; Final Office Action dated Oct. 16, 2019 in U.S. Appl. No. 15/934,740.

PCT; International Search Report and Written Opinion dated Sep. 26, 2019 in Application No. PCT/US2019/39944.

Sneider, "Kizik Handsfree New York Shoe Review," https://the-gadgeteer.com/2018/06/27/kizik-handsfree-new-york-show-review/ (2018).

U.S. Appl. No. 62/186,148, filed Jun. 29, 2015, Zahabian.

U.S. Appl. No. 62/186,148, filed Jun. 2015, Metz.

USPTO; Restriction Requirement dated Jan. 2, 2015 in U.S. Appl. No. 13/509,780.

USPTO; Office Action dated Apr. 10, 2015 in U.S. Appl. No. 13/509,780.

USPTO; Final Office Action dated Oct. 27, 2015 in U.S. Appl. No. 13/509,780.

USPTO; Office Action dated Apr. 13, 2016 in U.S. Appl. No. 13/509,780.

USPTO; Final Office Action dated Oct. 11, 2016 in U.S. Appl. No. 13/509,780.

USPTO; Advisory Action dated Mar. 30, 2017 in U.S. Appl. No. 13/509,780.

USPTO; Office Action dated May 19, 2017 in U.S. Appl. No. 13/509,780.

USPTO; Notice of Allowance dated Dec. 26, 2017 in U.S. Appl. No. 13/509,780.

(56) References Cited

OTHER PUBLICATIONS

USPTO; Office Action dated Jun. 16, 2017 in U.S. Appl. No. 15/493,582.
USPTO; Notice of Allowance dated Oct. 11, 2017 in U.S. Appl. No. 15/493,582.
USPTO; Restriction Requirement dated Nov. 27, 2018 in U.S. Appl. No. 15/693,195.
USPTO; Office Action dated May 16, 2018 in U.S. Appl. No. 15/690,679.
USPTO; Final Office Action dated Oct. 9, 2018 in U.S. Appl. No. 15/690,679.
USPTO; Non-Final Office Action dated Apr. 8, 2019 in U.S. Appl. No. 15/693,195.
USPTO; Office Action dated May 16, 2018 in U.S. Appl. No. 15/934,740.
USPTO; Final Office Action dated Oct. 9, 2018 in U.S. Appl. No. 15/934,740.
CA; Office Action dated Nov. 7, 2013 in Canadian Application No. 2,784,281.
CN; Office Action dated May 23, 2014 in Chinese Application No. 201080061183.8.
JP; Office Action dated Oct. 15, 2013 in Japanese Application No. 2012-539036.
JP; Office Action dated May 13, 2014 in Japanese Application No. 2012-539036 (English translation not available).
JP; Notice of Allowance dated Mar. 3, 2015 in Japanese Application No. 2012-539036.
PCT; International Search Report and Written Opinion dated Feb. 23, 2011 in PCT Application No. PCT/US2010/056608.
PCT; International Search Report and Written Opinion dated Aug. 22, 2017 in PCT Application No. PCT/US2017/028774.
PCT; International Preliminary Report on Patentability dated Jun. 14, 2018 in Application No. PCT/2017/028774.
EP; Examination Report dated Jan. 22, 2018 from EP Application 10779652.6.
EP; Examination Report dated Sep. 4, 2018 from EP Application 10779652.6.

* cited by examiner

RAPID-ENTRY FOOTWEAR HAVING AN ACTUATOR ARM

CROSS-REFERENCE TO RELATED APPLICATIONS

This application claims the benefit of U.S. Provisional Patent Application No. 62/755,123, filed Nov. 2, 2018 entitled "RAPID-ENTRY FOOTWEAR HAVING AN ACTUATOR ARM," and U.S. Provisional Patent Application No. 62/691,201, filed Jun. 28, 2018 entitled "RAPID-ENTRY FOOTWEAR HAVING AN ACTUATOR ARM," both of which are incorporated herein by reference in their entireties.

BACKGROUND

1. Field

The present disclosure relates to rapid-entry footwear having an actuator arm.

2. Description of the Related Art

Whether due to inconvenience or inability, donning shoes, including tying or otherwise securing the same, may present difficulties to some individuals. The present disclosure addresses this need.

SUMMARY

Disclosed herein, according to various embodiments, is a rapid-entry shoe comprising an actuator arm, having a pivot point, and a closure system. Movement of the actuator arm from an uncollapsed position to a collapsed position opens the closure system and movement of the actuator arm from the collapsed position to the uncollapsed position closes the closure system, according to various embodiments.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, mechanical and structural changes may be made without departing from the spirit and scope of the disclosure. Thus, the detailed description herein is presented for purposes of illustration only and not of limitation. Like numerals may refer to like components.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, coupled or the like may include permanent (e.g., integral), removable, temporary, partial, full, and/or any other possible attachment option. Any of the components may be coupled to each other via bolts, dowels, glue, stitching, welding, soldering, brazing, sleeves, brackets, clips or other means known in the art or hereinafter developed. Additionally, any reference to without contact (or similar phrases) may also include reduced contact or minimal contact.

As used herein, a shoe is any footwear including but not limited to a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, a high top style boot, or other suitable type of shoe.

Figure 1A:
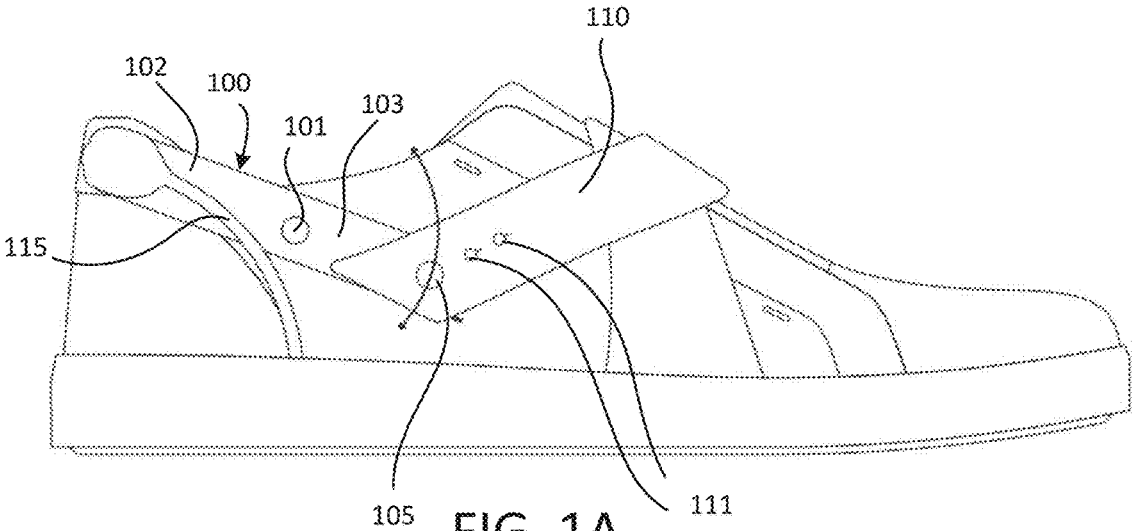
FIGS. 1A and 1B illustrate an example embodiment of a rapid-entry shoe having closure straps extending between actuator arms and the shoe upper or outsole, in uncollapsed and collapsed positions, respectively.
Figure 1B:
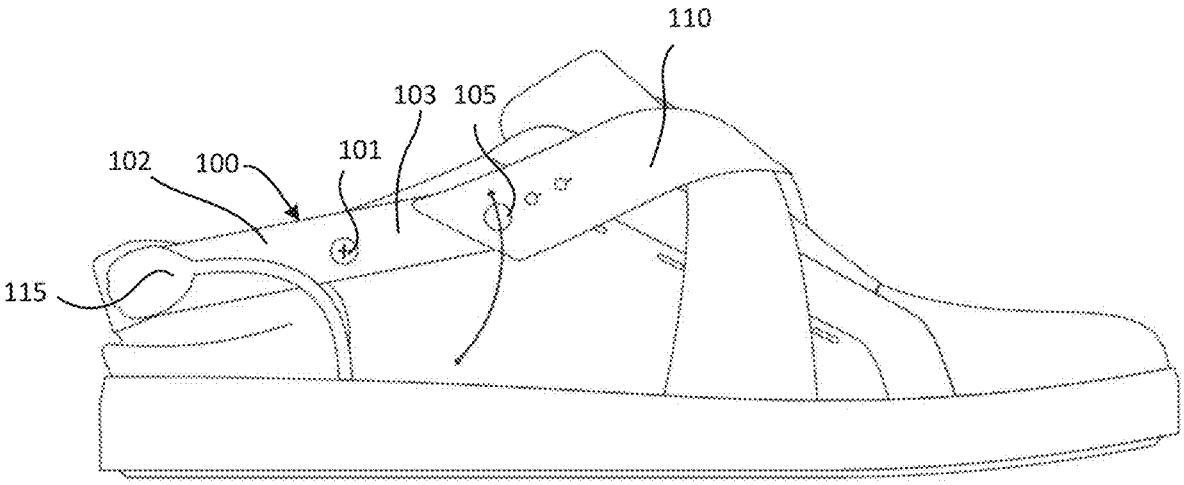

Example embodiments of the present disclosure comprise a shoe having an uncollapsed configuration (FIG. 1A) and a collapsed configuration with a wider opening to receive the foot of an individual wearing the shoe (FIG. 1B). With reference to FIGS. 1A and 1B, example embodiments of the present disclosure comprise an actuator arm 100 extending from a rear portion of the shoe (e.g., connected to the heel or a heel cap, heel counter or the like) and located on a medial and/or lateral side of the shoe. In various embodiments, the rapid-entry shoe also includes a closure system 110 coupled to the actuator arm 100. The actuator arm 100 may include a pivot point 101, and the actuator arm 100 may be generally configured to pivot about the pivot point 101. This pivoting motion of the actuator arm 100 may facilitate switching the shoe between the collapsed position and the uncollapsed position. That is, a user may press downward on the collar of the shoe, causing the actuator arm 100 to collapse, thereby causing the closure system 110 to open (e.g., the foot opening defined by the shoe to increase in size) and facilitating foot insertion. Thus, the actuator arm 100 may be in an uncollapsed position (FIG. 1A) or a collapsed position (FIG. 1B). Accordingly, the terms "collapsed position" or "collapsed configuration" refer to an open state of the shoe in which the rear portion of the shoe is deformed downward (e.g., the rear portion of the actuator arm pivots downward) and the foot opening defined by the shoe is enlarged to allow easier insertion of a foot of the user. Correspondingly, as used herein, the terms "uncollapsed position" or "uncollapsed configuration" refer to a closed state of the shoe in which the rear portion of the shoe is not deformed and is thus upward (relative to the collapsed position) and the foot opening defined by the shoe is sufficiently small to retain a foot within the shoe.

Example embodiments comprise a shoe having two actuator arms, each extending from a rear portion of the shoe (e.g., connected to the heel or a heel cap, heel counter or the like) and located on an opposing medial or lateral side of the shoe. In some embodiments, the actuator arms are coupled to one another around the rear portion of the shoe, while in other embodiments, the actuator arms are independent of each other. While much of the present disclosure will reference a single actuator arm for simplicity, persons skilled in the art will appreciate that two actuator arms, located on an opposing medial or lateral side of the shoe, will be used in various of the embodiments.

In example embodiments, the actuator arm is comprised of a material resistant to deformation, even elastic deformation, e.g., a rigid or hard polymer. In this regard, however, the actuator arm can comprise an overmold or other polymer or textile covering (including the shoe upper or a portion thereof) to minimize discomfort experienced by an individual wearing the shoe. In various embodiments, the actuator arm 100 includes a rear segment 102 and a forward segment 103, with the pivot point 101 disposed therebetween. That is, the portion of the actuator arm 100 behind the pivot point 101 is referred to as the rear segment 102 and the portion of the actuator arm 100 forward of the pivot point 101 is referred to as the forward segment 103, according to various embodiments.

In various embodiments, pivot point 101 is positioned away from the rear portion of the shoe, and is a fixed point around which the actuator arm 100 pivots. For example, in an uncollapsed position, the actuator arm may be oriented downward in the direction away from the rear portion of the shoe, while in a collapsed position, the actuator arm may be oriented level or upward in the direction away from the rear portion of the shoe. The actuator arm may be moved from the uncollapsed position to the collapsed position upon an individual's heel applying a downward force to the rear portion of the shoe upon entry. In various embodiments, movement of the actuator arm 100 from the uncollapsed position to the collapsed position (e.g., transitioning from FIG. 1A to 1B) comprises downward rotational movement of the rear segment 102 and upward rotational movement of the forward segment 103. Correspondingly, movement of the actuator arm 100 from the collapsed position to the uncollapsed position (e.g., transitioning from FIG. 1B to 1A) comprises upward rotational movement of the rear segment 102 and downward rotational movement of the forward segment 103. Thus, the pivot point 101 may be a fulcrum of the actuator arm.

Figure 6A:
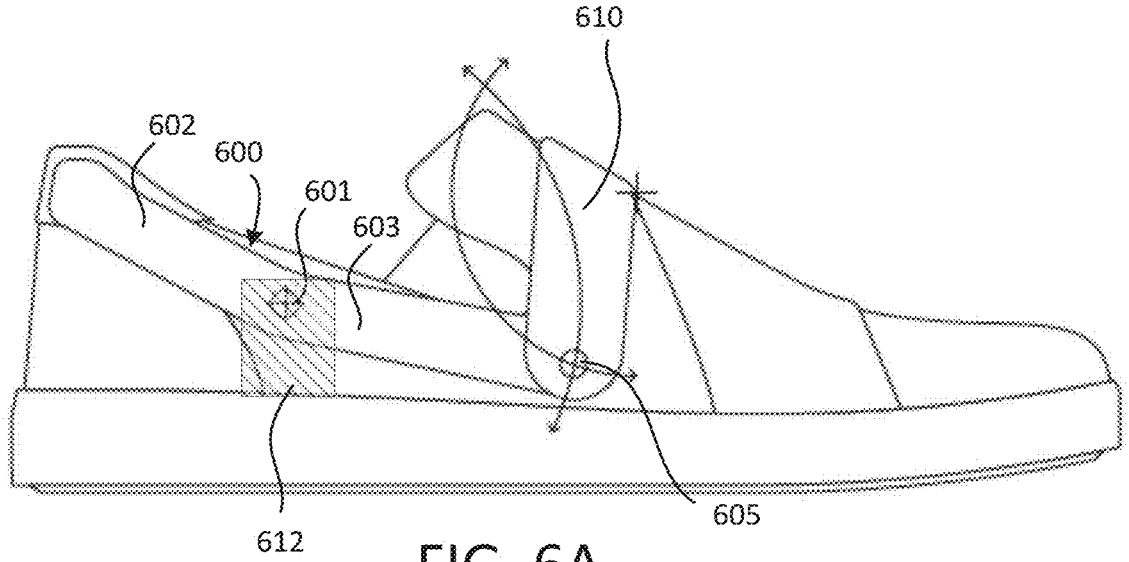
FIGS. 6A and 6B illustrate another example embodiment of a rapid-entry shoe having an angled, bi-stable actuator arm, in uncollapsed and collapsed positions, respectively.
Figure 6B:
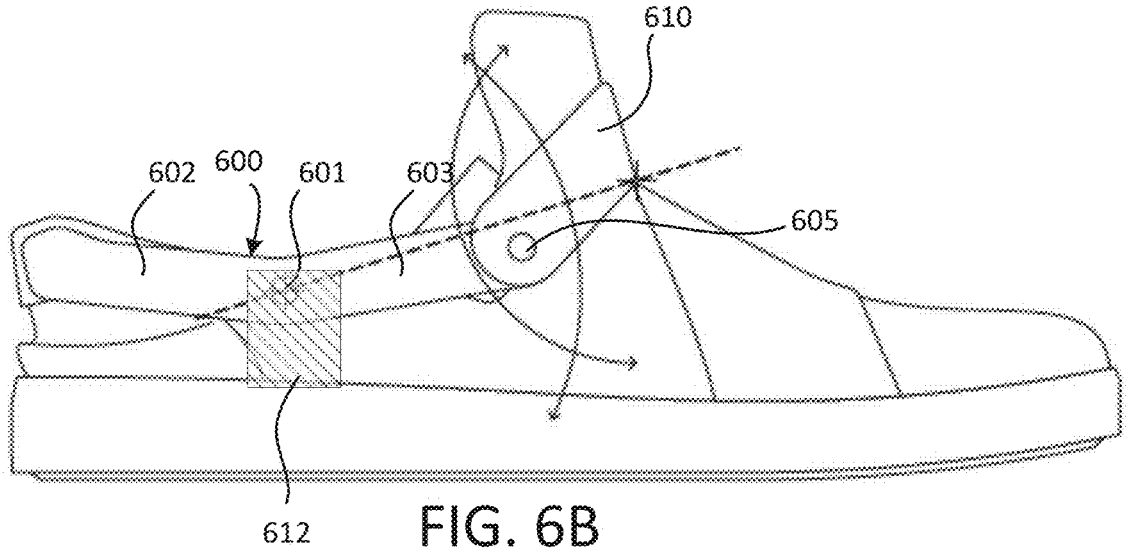
Figure 7A:
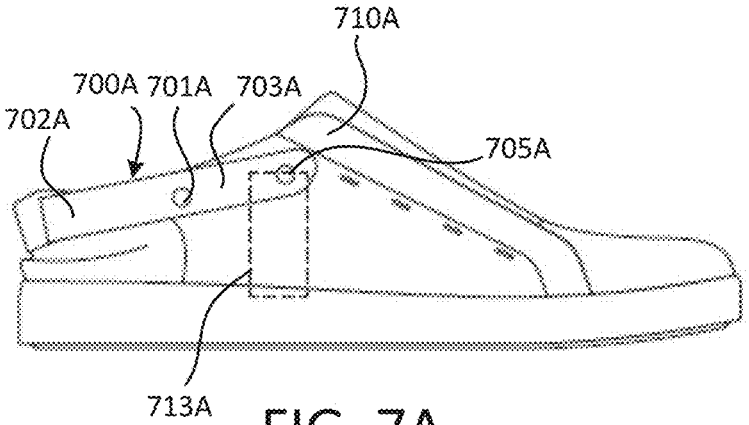
FIG. 7A illustrates an example embodiment of a rapid-entry shoe not comprising a closure strap.
Figure 7B:
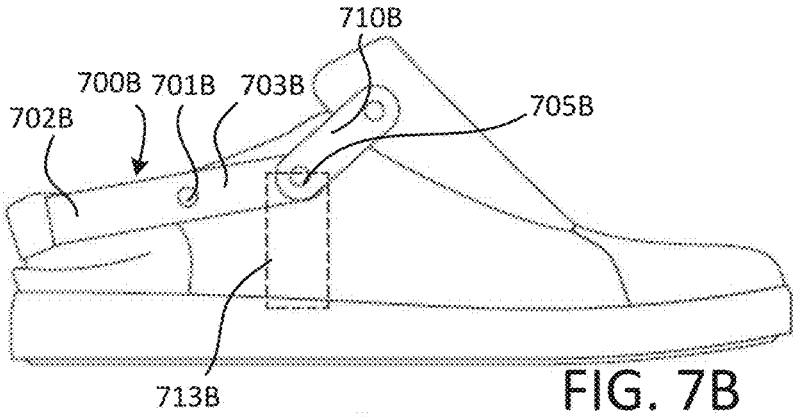
FIGS. 7B, 7C and 7D illustrate example embodiments of rapid-entry shoes similar to those shown in FIGS. 2B, 1B and 3B, respectively, but not comprising deformable elements and showing a biasing member disposed below a coupling point.
Figure 7C:
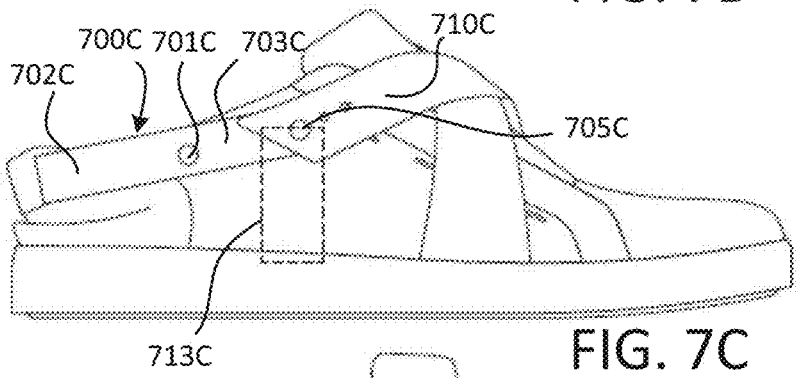
Figure 7D:
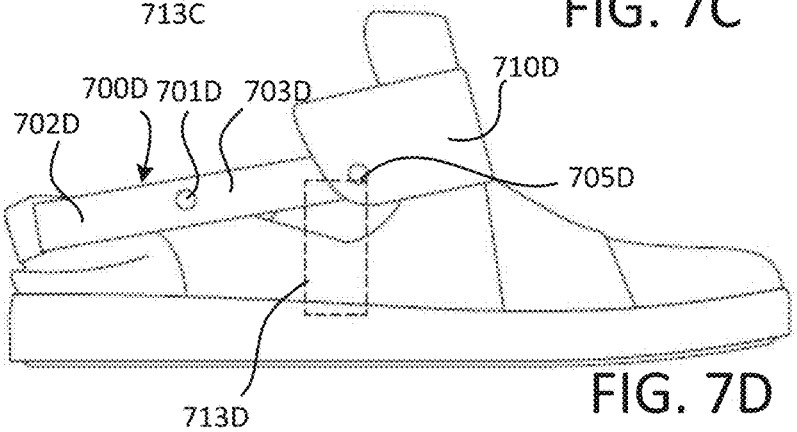

The pivot point may be located between the footbed and topline of the shoe. In various embodiments, the pivot point is below the footbed. The pivot point may comprise a rivet, pin, snap or other structure between the actuator arm and the shoe upper or outsole to provide for rotation there between. In example embodiments, and with momentary reference to FIGS. 6A and 6B, a rigid support 612 may be located below the pivot point 601. The rigid support may be included to prevent collapse of the shoe upper during transition from the uncollapsed position to the collapsed position. For example, the pivot point may be mounted to the rigid support 612. The rigid support 612 may form part of the upper of the shoe, or may be an extension of the outsole or trims. In various embodiments, the pivot point may be fixed and thus may not move relative to the shoe. In various embodiments, the pivot point may be fixed vertically (e.g., may not move upward or downward), but the pivot point may have some play in the forward and rear directions.

In various embodiments, the closure system 110 may be coupled to the forward segment 103 of the actuator arm 100 (e.g., at coupling point 105). Said differently, the actuator arm 100, in accordance with various embodiments, comprises a coupling point 105 positioned further away from the rear portion of the shoe than the pivot point 101, and the coupling point 105 may enable relative rotation between the actuator arm and the closure system. At the coupling point 105, the actuator arm can be coupled to the closure system 110. In various embodiments, the coupling point 105 may be located between the footbed and topline of the shoe. As mentioned below, the coupling point 105 may be nearer to the footbed than the pivot point 101 in the uncollapsed position, but the pivot point 101 may be nearer to the footbed than the coupling point 105 in the collapsed position.

Figure 2A:
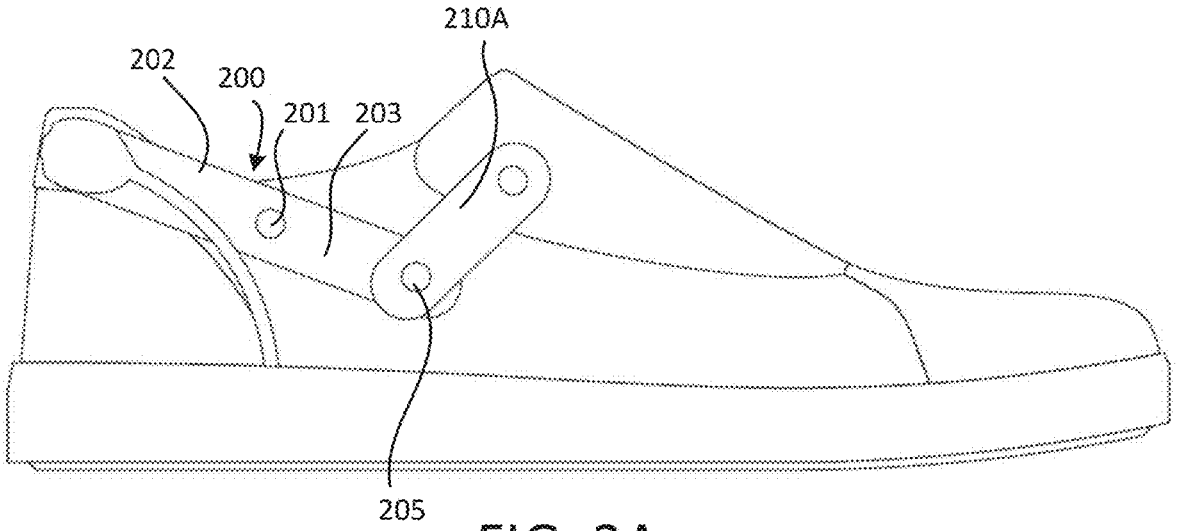
FIGS. 2A and 2B illustrate an example embodiment of a rapid-entry shoe having different closure systems, in uncollapsed and collapsed positions, respectively.
Figure 2B:
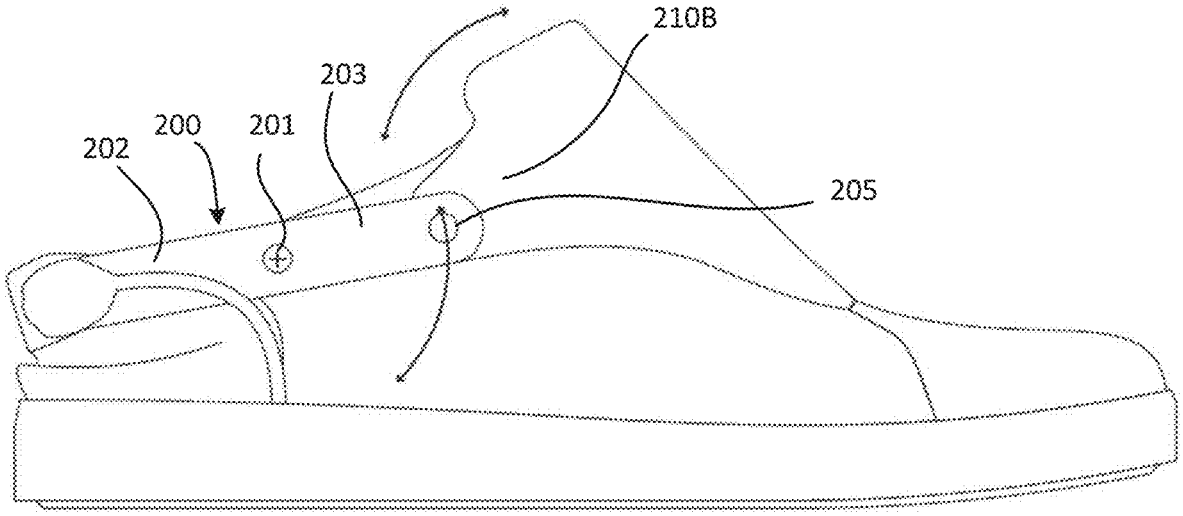

As used herein, the term closure system refers generally to a feature of the shoe that is coupled to the actuator arm at the coupling point. The pivoting movement of the actuator arm is perpetuated by the closure system to enlarge and decrease the foot opening defined by the shoe. In various embodiments, and with reference to FIG. 2A, closure system may be a link 210A (e.g., an additional actuator arm) that extends from the forward segment 203 (e.g., from the coupling point 205) of the actuator arm 100 and is coupled to an upper forward portion of the shoe. In various embodiments, and with reference to FIG. 2B, the closure system is a tongue, closure strap 210B, or other feature of the shoe upper. In such embodiments, downward force on the rear segment 202 of the actuator arm 200 causes the actuator arm 200 to pivot about the pivot point 201, thereby causing the forward segment 203 to move upward, causing a corresponding forward and/or upward movement of the closure system 210A, 210B. In various embodiments, in the uncollapsed position the coupling point 205 is closer to a footbed of the rapid-entry shoe than the pivot point 201, and in the collapsed position the coupling point 205 is farther above the footbed than the pivot point 201. In various embodiments, and with momentary reference to FIGS. 8A and 8B, the actuator arm and closure system could be made of a single part, such that the coupling point could be a living hinge. Additional details pertaining to the living hinge are included below with reference to FIGS. 8A and 8B.

In accordance with example embodiments of the present disclosure, and with momentary reference to FIGS. 5A, 5B, 6A, and 6B, actuator arm 500, 600 may have one or more bends or angles along its axis. That is, instead of the actuator arm being linear when viewed from a lateral or medial side of the rapid entry shoe (see, e.g., FIGS. 1A, 1B, 2A, 2B, 3A, and 3B), the actuator arm may be non-linear (once again, when viewed from a lateral or medial side of the rapid-entry shoe). For example, an angle may be defined between the rear segment 502, 602 and the forward segment 503, 603 of the actuator arm 500, 600, and this angle may be less than 180 degrees. The one or more bends or angles can, in turn, follow the topline of the shoe and/or provide for stability in both the uncollapsed position as well as the collapsed position, depending on where the actuator arm is positioned relative to the rotation center point.

Figure 4A:
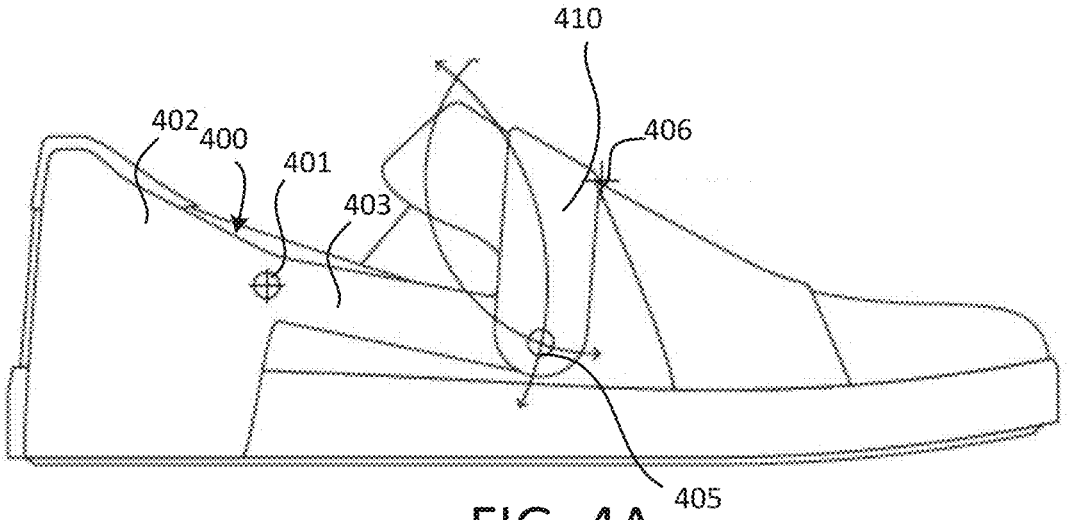
FIGS. 4A and 4B illustrate an example embodiment of a rapid-entry shoe wherein the actuator arm is the heel or a heel cap, heel counter or the like, in uncollapsed and collapsed positions, respectively.
Figure 4B:
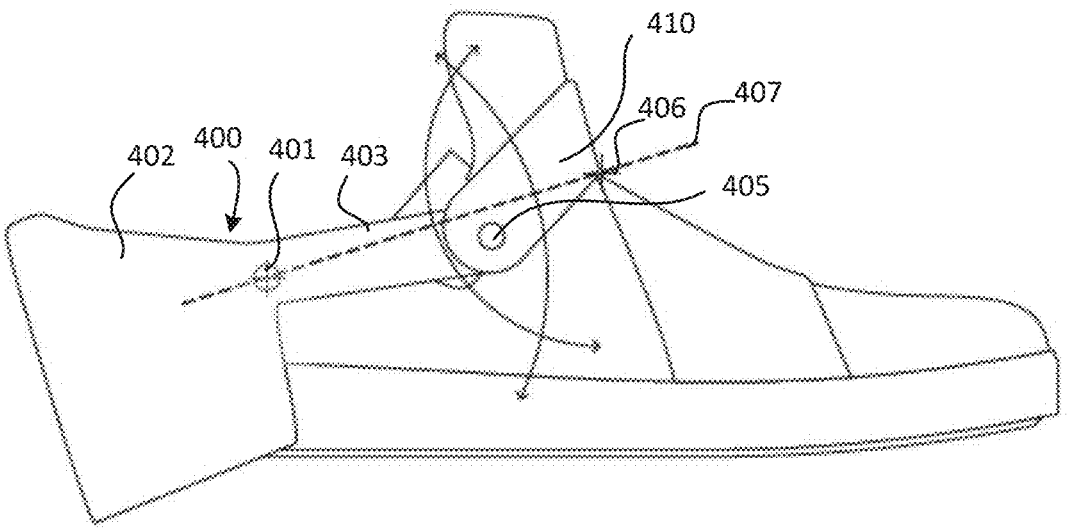
Figure 5A:
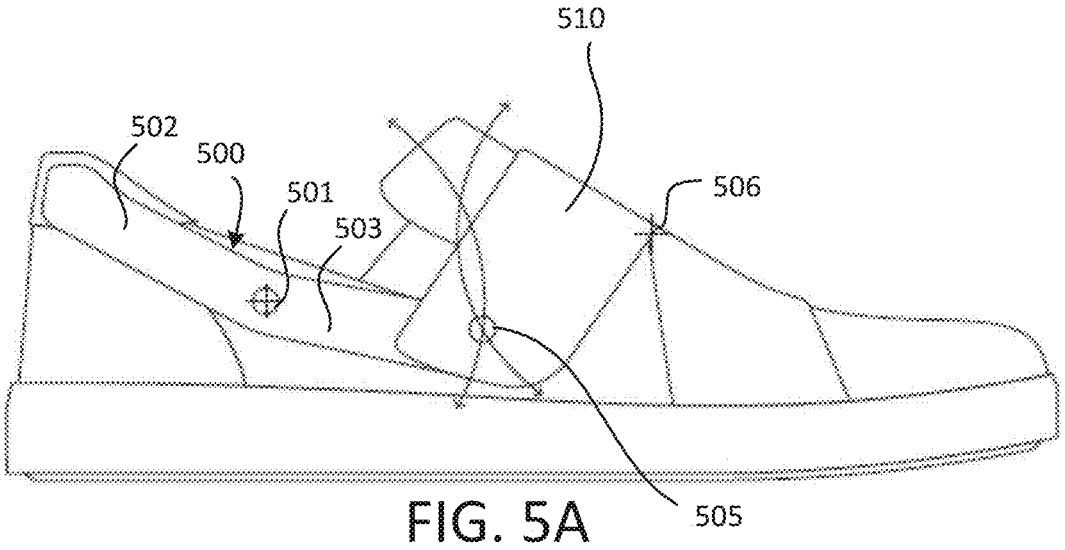
FIGS. 5A and 5B illustrate an example embodiment of a rapid-entry shoe having an angled, bi-stable actuator arm, in uncollapsed and collapsed positions, respectively.
Figure 5B:
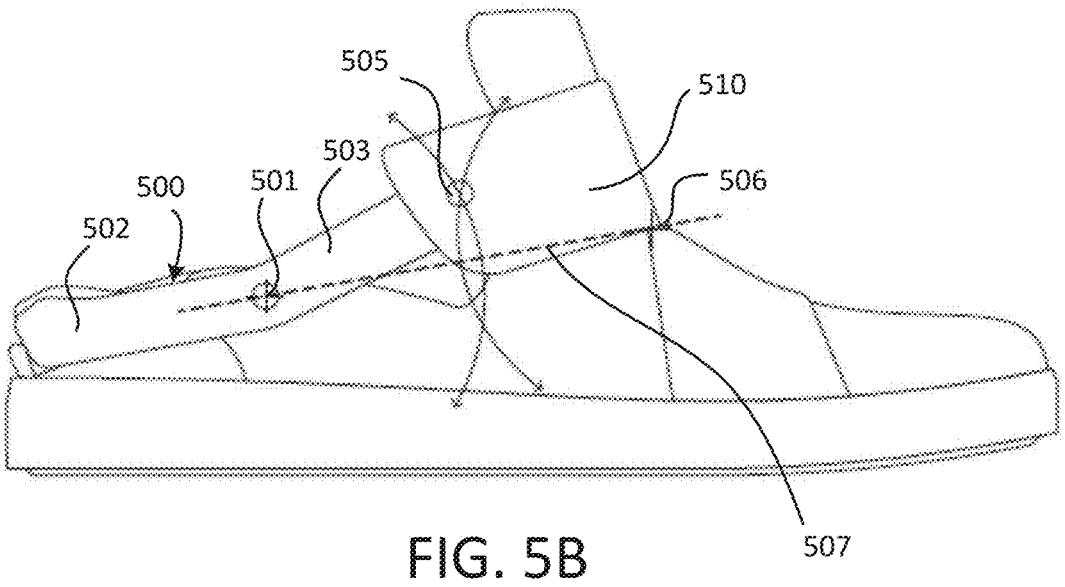

In various embodiments, and with reference to FIGS. 4A and 4B, instead of the actuator arm being connected to the heel, heel cap, heel counter, or the like, the actuator arm 400 is the heel, heel cap, heel counter, or the like. Thus, in the collapsed configuration, the heel or a heel cap, heel counter or the like may be located below the footbed as illustrated in FIG. 4B. The actuator arm in such embodiments may be moved from the uncollapsed position to the collapsed position upon an individual's heel applying a downward force to the footbed of the shoe upon entry.

In various embodiments, and with continued reference to FIGS. 4A and 4B, a bend axis 406 may be defined as an axis, perpendicular to a longitudinal axis of the shoe from a heel portion to a toe portion, that extends along an intersection of the closure system 410 and an upper forward portion of the rapid-entry shoe or the shoe upper. An alignment line 407 extending through the pivot point 401 and the bend axis 406 may be farther above a footbed of the rapid-entry shoe than the coupling point 405 in both the collapsed and uncollapsed positions. However, in various embodiments, and with reference to FIGS. 5A and 5B, the alignment line 507 extending through the pivot point 501 and the bend axis 506 is closer to the footbed than the coupling point 505 in the collapsed position. That is, the alignment line 507 may be disposed between the footbed of the shoe and the coupling point 505, at least in the collapsed position. Such a configuration may enable bi-stability of the rapid-entry shoe. That is, the shoe in the uncollapsed position is not biased toward the collapsed position, and the shoe in the collapsed position is not biased toward the uncollapsed position. Additional details pertaining to biasing are included below.

Figure 3A:
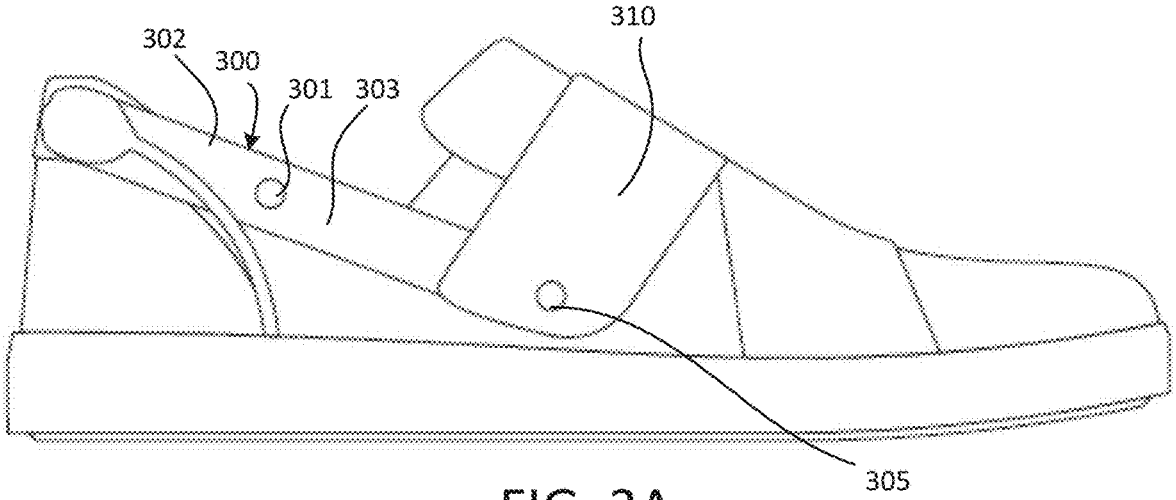
FIGS. 3A and 3B illustrate an example embodiment of a rapid-entry shoe having closure straps extending between actuator arms, in uncollapsed and collapsed positions, respectively.
Figure 3B:
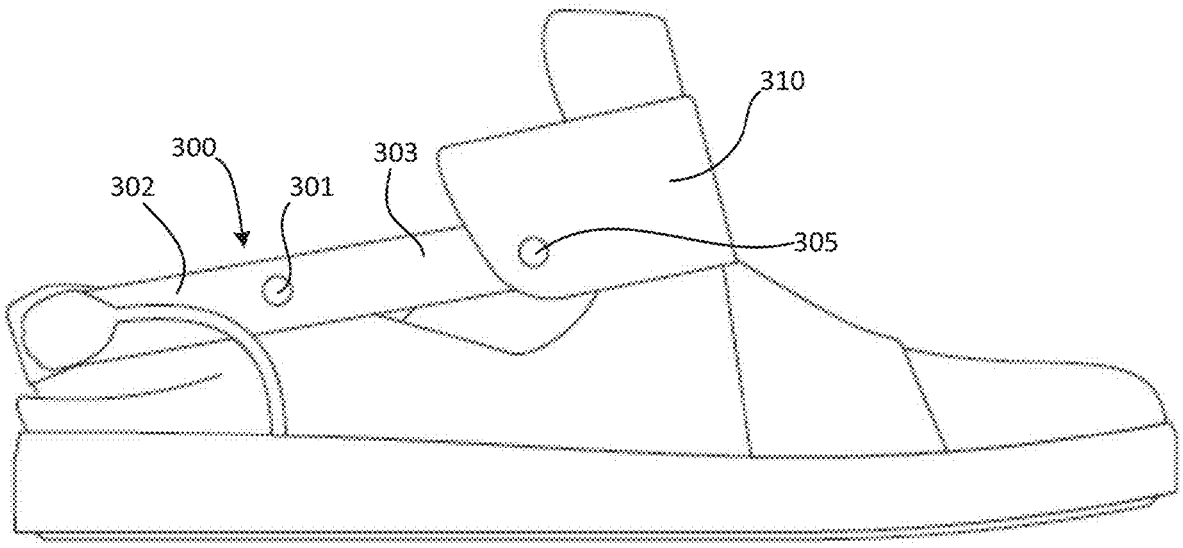

A closure system 110, as mentioned above, may include comprise a closure strap. In some embodiments, as illustrated in FIG. 1A, a first closure strap extends around the shoe upper between a first actuator arm on a medial side and the shoe upper or outsole on a lateral side, and a second closure strap extends around the shoe upper between a second actuator arm on a lateral side and the shoe upper or outsole on a medial side. In other embodiments, a closure strap extends around the shoe upper between a first actuator arm on a medial side and a second actuator arm on a lateral side as illustrated in FIGS. 3A and 3B. Persons skilled in the art will appreciate that the first and second actuator arms may be coupled to one another around the rear portion of the shoe, or the actuator arms may be independent of each other, or a single actuator arm may extend around the rear portion of the shoe and have respective pivot points on the medial and lateral side of the shoe.

In example embodiments, and returning to reference FIG. 1A, the closure system may be coupled to the tongue. In other example embodiments, the closure strap is coupled to the shoe upper at the vamp where it has a natural pivot point. In yet other example embodiments, the closure strap has multiple attachment points 111 to the actuator arm at the coupling point, e.g., to provide for adjustability.

In general, movement of the actuator arm from the uncollapsed position to the collapsed position can open the closure system (e.g., raise the tongue and/or closure strap away from the shoe upper), while movement of the actuator arm from the collapsed position to the uncollapsed position can close the closure system (e.g., lower the tongue and/or closure strap toward the shoe upper). As the actuator arm rotates it moves the closure system (and whatever it is coupled to) upward and away from the quarters and throat of the upper, making the opening wider.

In some embodiments, movement of the actuator arm from the collapsed position to the uncollapsed position can be facilitated by one or more resiliently deformable elements 115, e.g., extending from below the footbed of the shoe to the rear portion of the shoe, e.g., as described in U.S. Pat. No. 9,820,527, which is incorporated herein by reference for all purposes. The resiliently deformable element(s) 115 may provide a rebounding action to return the heal of the shoe to the closed position (uncollapsed position). The resiliently deformable element may be coupled to and may extend from below a footbed of the rapid-entry shoe.

In other example embodiments, and with momentary reference to FIGS. 7A, 7B, 7C and 7D, movement of actuator arm 700A, 700B, 700C, 700D from the collapsed position to the uncollapsed position can be facilitated by the inclusion of a biasing member 713A, 713B, 713C, 713D, such as an elastic gore or other material, located below the coupling point. The biasing member may exert a downward force to at least one of the forward segment 703A, 703B, 703C, 703D of the actuator arm 700A, 700B, 700C, 700D and the closure system 710A, 710B, 710C, 710D. Accordingly, because each of the embodiments depicted in FIGS. 7A,7B, 7C, and 7D is shown in the collapsed position, the biasing member 713A, 713B, 713C, 713D in each of these figures may be in an elongated state, thereby resulting in an increased bias to return to the shoe to the uncollapsed state.

Figure 8A:
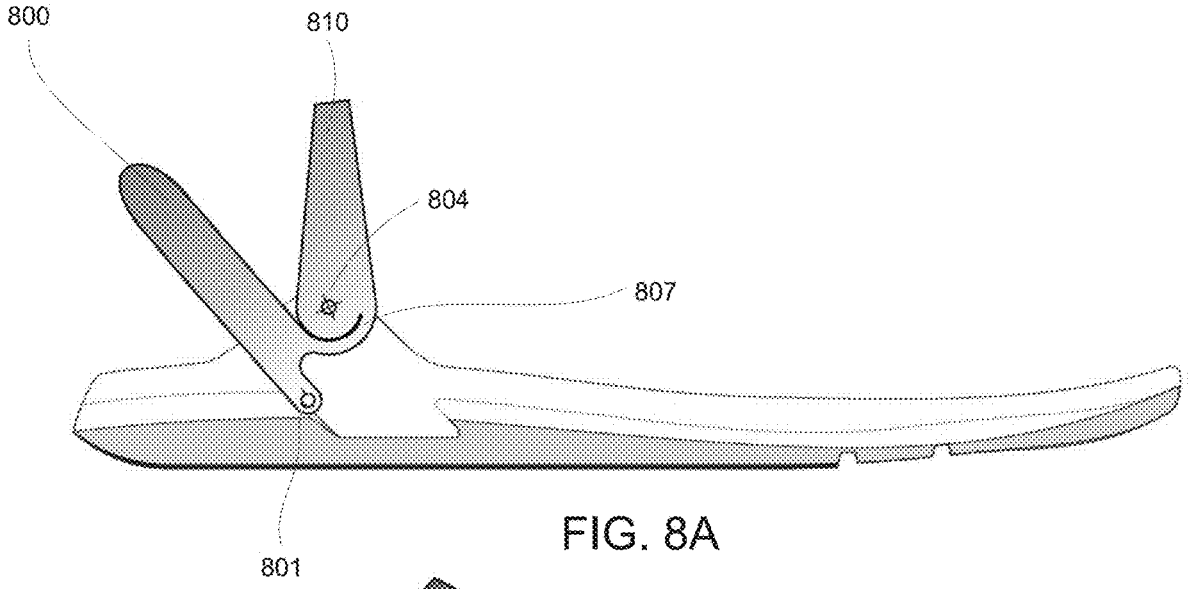
FIGS. 8A and 8B illustrate an example embodiment of a rapid-entry shoe having a living hinge, in uncollapsed and collapsed positions, respectively.
Figure 8B:
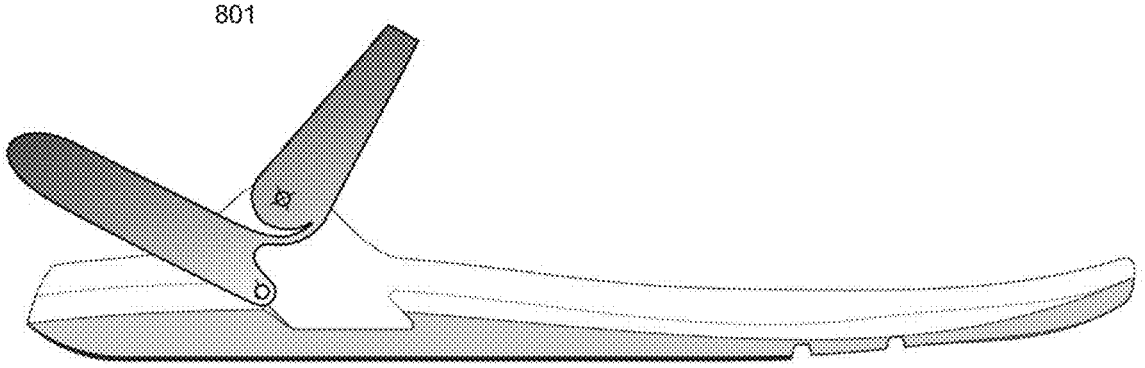

With reference now to FIGS. 8A and 8B, an additional embodiment is disclosed of a rapid-entry shoe, also having an uncollapsed configuration (FIG. 8A) and a collapsed configuration with a wider opening to receive the foot of an individual wearing the shoe (FIG. 8B). The shoe can comprise an actuator arm 800 and a closure system 810 (e.g., a closure trap or tongue). Actuator arm 800 and/or closure system 810 can extend between medial and lateral sides of the shoe, as previously mentioned. Both the actuator arm 800 and the closure system 810 may include respective pivot points 801, 804 (e.g., a first pivot point 801 and a second pivot point 804). In various embodiments, the actuator arm 800 and the closure system 810 are integrally formed of the same material (e.g., form a unitary, monolithic structure).

The shoe can comprise one or more pivot points 801 and 804, each on the medial and/or lateral side of the shoe, which in turn can comprise one or more of a rivet, pin, snap or other structure to provide for relative rotation. Pivot points 801 and 804 can be attached to a base, whether directly or indirectly. For example, pivot point 801 can provide for relative rotation between actuator arm 800 and a base. Similarly, pivot point 804 can provide for relative rotation between closure system 810 and a base. Optionally, one or more pivot points 801 and 804 can also anchor actuator arm 800 and/or closure system 810 relative to a base. As used herein, a "base" may refer to a stable base plate in the shoe, an outsole or portions thereof, a midsole or portions thereof, an insole or portions thereof, a wedge or portions thereof, the upper or portions thereof (e.g., a heel counter), or other suitable structure disposed between and/or adjacent to foregoing.

In various embodiments, a living hinge is formed between the actuator arm and the closure system. That is, the hinge may be made from the same material as and/or integral with the two pieces it connects. The living hinge may facilitate relative movement of the actuator arm and the closure system. That is, movement of the actuator arm from an uncollapsed position to a collapsed position opens the closure system, and wherein movement of the actuator arm from the collapsed position to the uncollapsed position closes the closure system. In various embodiments, the living hinge 807 is formed in part by a narrowed strip of the forward segment of the actuator arm 800 includes. The narrowed strip of material, which may be resiliently flexible, transitions from the actuator arm 800 to the closure system 810. An edge of the closure system may have a rounded edge, such that the narrowed strip of material extends adjacent to the rounded edge (e.g., extending forward and under the rounded edge of closure system 810). A slit may be defined between the rounded edge and the narrowed strip of material, wherein a dimension of the slit is greater in the collapsed position than in the uncollapsed position. In various embodiments, the narrowed strip of material extends from a forward edge of the closure system.

Actuator arm 800 and closure system 810 can be coupled to each other at a coupling point, as described supra, on the medial and/or lateral side of the shoe. In the illustrated embodiment, however, actuator arm 800 and closure system 810 are coupled to each other with a living hinge 807, on the medial and/or lateral side of the shoe.

As illustrated in the progression from an uncollapsed configuration (FIG. 8A) to a collapsed configuration (FIG. 8B), moving actuator arm 800 or closure system 810 in a first direction will move the other in a second direction, opposite the first, via hinge 807. Such movement of actuator arm 800 or closure system 810 in a first direction can be accomplished by a pushing or pulling motion exerted thereto, whether directly or indirectly, by an individual wearing the shoe. This embodiment may be particularly advantageous in connection with a high top style boot. The actuator arms can be returned to their original positions by lestic or deformable elements positioned to pull or push the arms back into place.

Figure 9A:
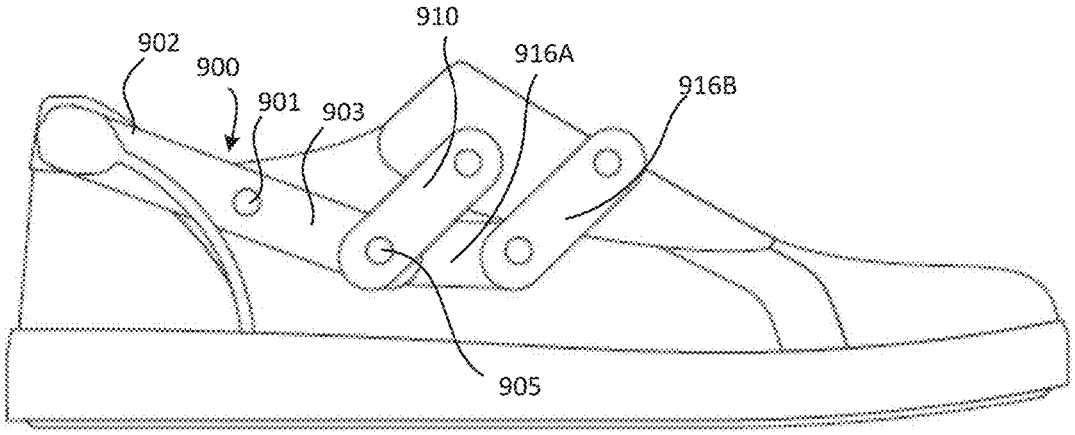
FIGS. 9A and 9B illustrate an example embodiment of a rapid-entry shoe having multiple links extending from an actuator arm, in uncollapsed and collapsed positions, respectively.
Figure 9B:
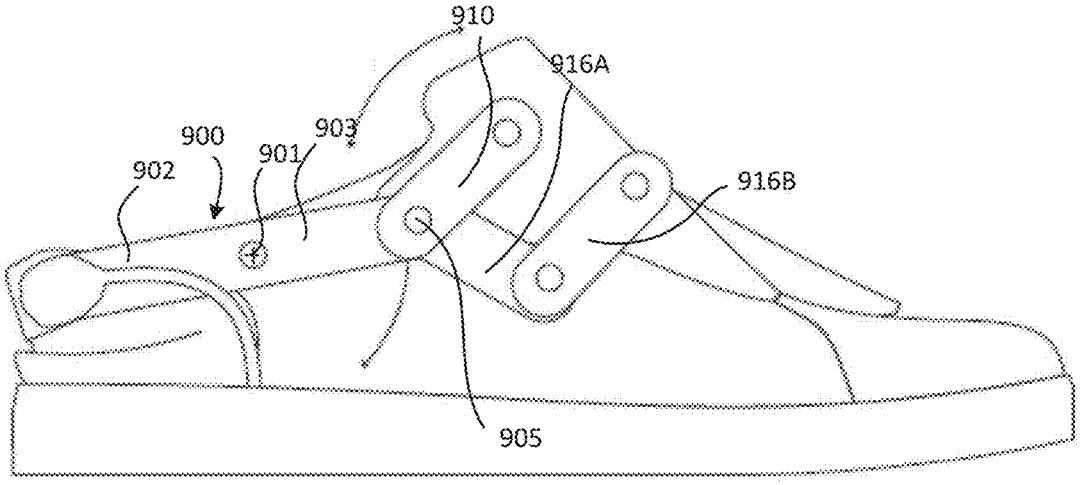
Figure 10A:
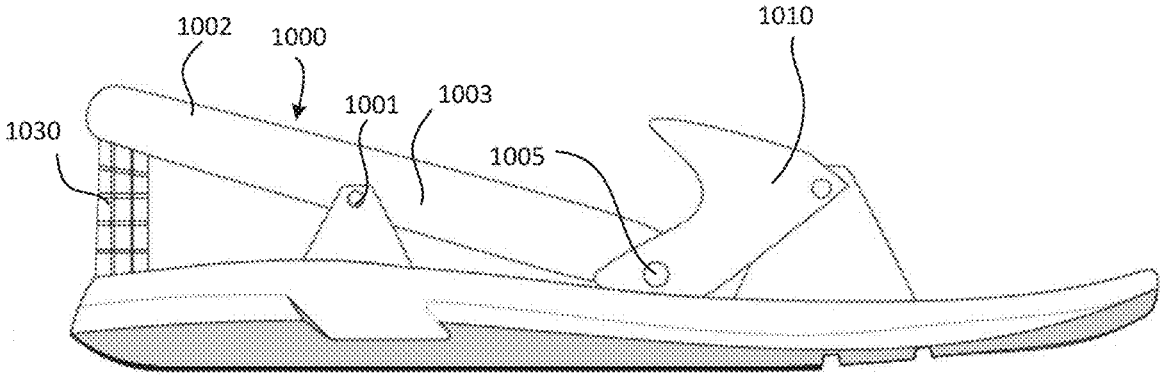
FIGS. 10A, 10B, 10C, 10D, and 10E illustrate example embodiments of a rapid-entry shoe having a collapsible rear support.
Figure 10B:
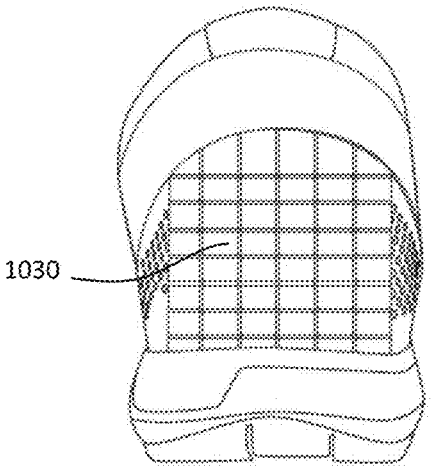
Figure 10C:
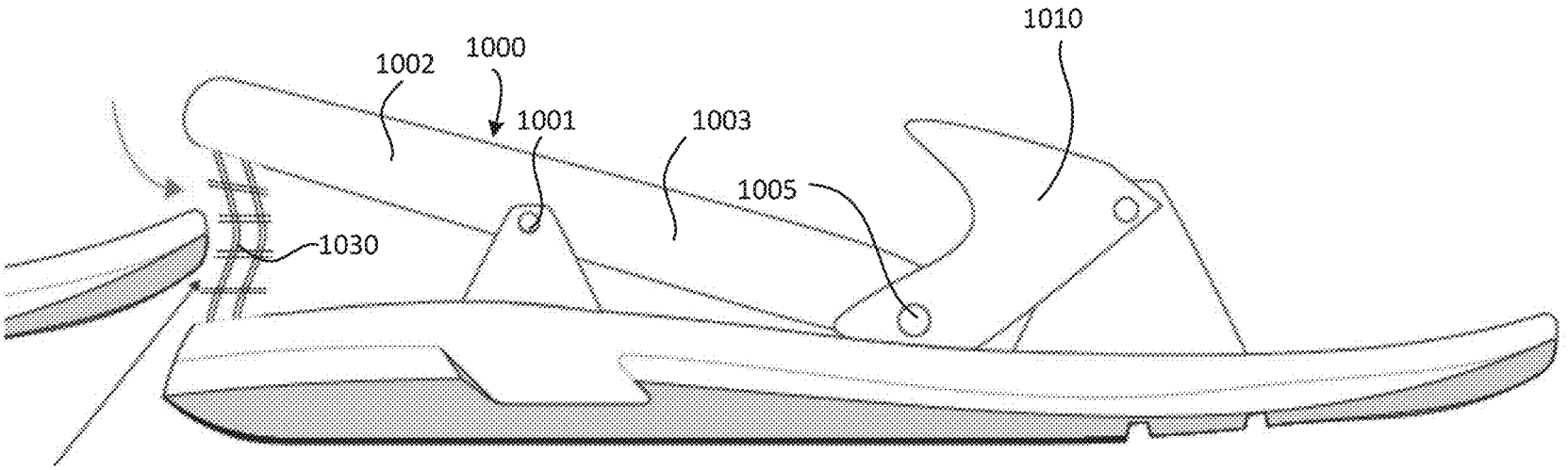
Figure 10D:
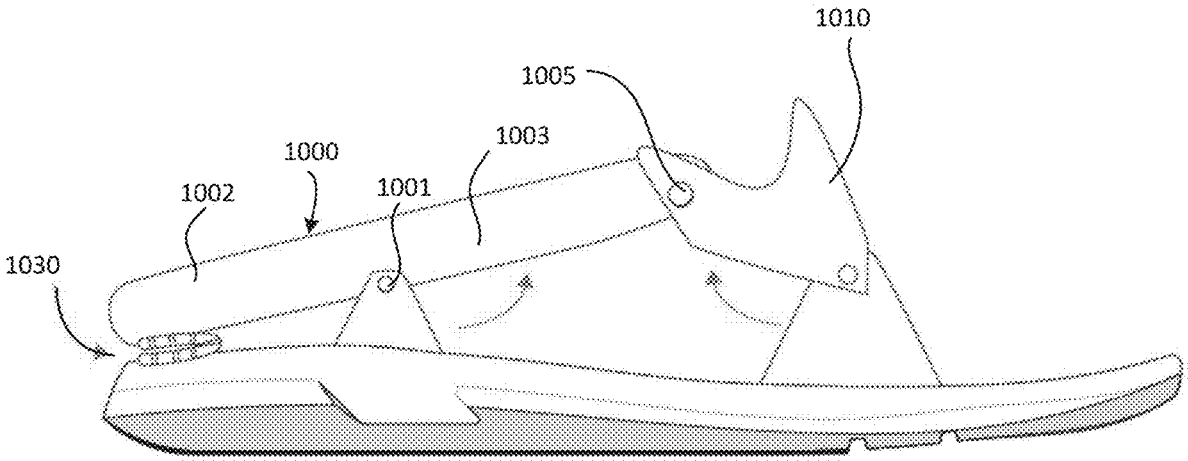
Figure 10E:
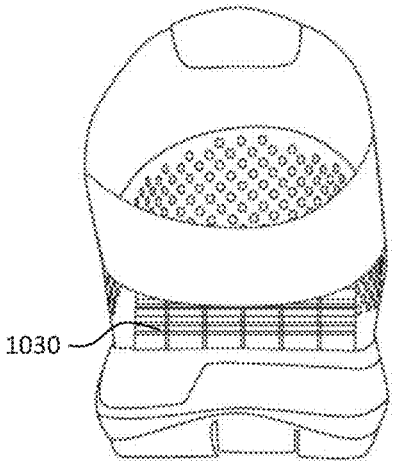

In various embodiments, and with reference to FIGS. 9A and 9B, the closure system may include a link 910 coupled to the forward segment 903 of the actuator arm 900 at the coupling point 905. The link 910 may extend from the coupling point 905 and may be coupled to or form a first part of a forward upper portion of the rapid-entry shoe. The link 910 may be a first link, and the closure system may further include a second link also coupled to the forward segment 903 of the actuator arm 900 at the coupling point 905. The second link may extend from the coupling point and may be coupled to or form a second part of the forward upper portion of the rapid-entry shoe. The second link may include a first section 916A and a second section 916B.

In various embodiments, and with reference to FIGS. 10A, 10B, 10C, 10D, and 10E, the rapid entry shoe includes a rear support portion 1030 extending between the rear segment 1002 and a base of the rapid-entry shoe. The rear support portion 1030 may be configured to bias the rapid-entry shoe toward the uncollapsed position, but can be momentarily deflected to allow the rear support portion 1030 to collapse to transition from the uncollapsed position to the collapsed position. The rear support portion 1030 may include horizontal and vertical grooves, thereby allowing bending in two directions, but only a single direction at a time.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rapid-entry shoe comprising:

an upper comprising a rear portion, wherein the rear portion has an uncollapsed position and deforms to a collapsed position; and an actuator arm comprising a pivot point and a closure system coupled to the actuator arm;

wherein movement of the actuator arm from the uncollapsed position to the collapsed position opens the closure system to provide a wider opening to receive a wearer's foot, and wherein movement of the actuator arm from the collapsed position to the uncollapsed position closes the closure system;

wherein the actuator arm comprises a rear segment and a forward segment, wherein the pivot point is disposed between the rear segment and the forward segment and the closure system is coupled to the forward segment of the actuator arm;

wherein a coupling point between the forward segment of the actuator arm and the closure system enables relative rotation of the actuator arm and the closure system; and wherein in the uncollapsed position the coupling point is closer to a footbed of the rapid-entry shoe than the pivot point, and wherein in the collapsed position the coupling point is farther above the footbed than the pivot point.

2. A rapid-entry shoe comprising:

an upper comprising a rear portion, wherein the rear portion has an uncollapsed position and deforms to a collapsed position; and an actuator arm comprising a pivot point; and a closure system coupled to the actuator arm;

wherein movement of the actuator arm from the uncollapsed position to the collapsed position opens the closure system to provide a wider opening to receive a wearer's foot, and wherein movement of the actuator arm from the collapsed position to the uncollapsed position closes the closure system;

wherein the actuator arm comprises a rear segment and a forward segment, wherein the pivot point is disposed between the rear segment and the forward segment and the closure system is coupled to the forward segment of the actuator arm;

wherein a coupling point between the forward segment of the actuator arm and the closure system enables relative rotation of the actuator arm and the closure system; and further comprising a bend axis between a forward end of the closure system and an upper forward portion of the rapid-entry shoe, wherein an alignment line extending through the pivot point and the bend axis is closer to a footbed of the rapid-entry shoe than the coupling point such that the alignment line is disposed between the coupling point and the footbed.

3. A rapid-entry shoe comprising:

an upper comprising a rear portion, wherein the rear portion has an uncollapsed position and deforms to a collapsed position; and an actuator arm comprising a pivot point; and a closure system coupled to the actuator arm;

wherein movement of the actuator arm from the uncollapsed position to the collapsed positior opens the closure system to provide a wider opening to receive a wearer's foot, and wherein movement of the actuator arm from the collapsed position to the uncollapsed position closes the closure system;

wherein the actuator arm comprises a rear segment and a forward segment, wherein the pivot point is disposed between the rear segment and the forward segment and the closure system is coupled to the forward segment of the actuator arm;

wherein a coupling point between the forward segment of the actuator arm and the closure system enables relative rotation of the actuator arm and the closure system; and further comprising a bend axis between a forward end of the closure system and an upper forward portion of the rapid-entry shoe, wherein an alignment line extending through the pivot point and the bend axis is farther above a footbed of the rapid-entry shoe than the coupling point such that the coupling point is disposed between the alignment line and the footbed.

4. A rapid-entry shoe comprising:

an upper comprising a rear portion, wherein the rear portion has an uncollapsed position and deforms to a collapsed position; and an actuator arm comprising a pivot point and a closure system coupled to the actuator arm;

wherein movement of the actuator arm from the uncollapsed position to the collapsed position opens the closure system to provide a wider opening to receive a wearer's foot, and wherein movement of the actuator arm from the collapsed position to the uncollapsed position closes the closure system;

wherein the actuator arm comprises a rear segment and a forward segment, wherein the pivot point is disposed between the rear segment and the forward segment and the closure system is coupled to the forward segment of the actuator arm;

wherein a coupling point between the forward segment of the actuator arm and the closure system enables relative rotation of the actuator arm and the closure system;

wherein the pivot point is disposed above a footbed of the rapid-entry shoe; and further comprising a rigid support, wherein the pivot point is mounted to the rigid support.

5. The rapid-entry shoe of claim 4, wherein the rigid support is at least one of a portion of an upper of the rapid-entry shoe or an extension of an outsole of the rapid-entry shoe.

6. The rapid-entry shoe of claim 5, wherein the rigid support prevents upward and downward movement of the pivot point.

7. A rapid-entry shoe comprising:

an upper comprising a rear portion, wherein the rear portion has an uncollapsed position and deforms to a collapsed position; and an actuator arm comprising a pivot point; and a closure system coupled to the actuator arm;

wherein movement of the actuator arm from the uncollapsed position to the collapsed position opens the closure system to provide a wider opening to receive a wearer's foot, and wherein movement of the actuator arm from the collapsed position to the uncollapsed position closes the closure system;

wherein the actuator arm comprises a rear segment and a forward segment, wherein the pivot point is disposed between the rear segment and the forward segment and the closure system is coupled to the forward segment of the actuator arm;

wherein a coupling point between the forward segment of the actuator arm and the closure system enables relative rotation of the actuator arm and the closure system; and wherein the closure system comprises a link coupled to the forward segment of the actuator arm at the coupling point, wherein the link extends from the coupling point and is coupled to or forms a first part of a forward upper portion of the rapid-entry shoe.

8. The rapid-entry shoe of claim 7, wherein the link is a first link, wherein the closure system further comprises a second link coupled to the forward segment of the actuator arm at the coupling point, wherein the second link extends from the coupling point and is coupled to or forms a second part of the forward upper portion of the rapid-entry shoe.

9. The rapid-entry shoe of claim 8, wherein the second link comprises a first section and a second section coupled together.

10. A rapid-entry shoe comprising:

an upper comprising a rear portion, wherein the rear portion has an uncollapsed position and deforms to a collapsed position; and an actuator arm comprising a pivot point; and a closure system coupled to the actuator arm;

wherein movement of the actuator arm from the uncollapsed position to the collapsed position opens the closure system to provide a wider opening to receive a wearer's foot, and wherein movement of the actuator arm from the collapsed position to the uncollapsed position closes the closure system;

wherein the actuator arm comprises a rear segment and a forward segment, wherein the pivot point is disposed between the rear segment and the forward segment and the closure system is coupled to the forward segment of the actuator arm;

wherein a coupling point between the forward segment of the actuator arm and the closure system enables relative rotation of the actuator arm and the closure system; and further comprising a biasing member disposed below the coupling point and configured to apply a downward force to at least one of the forward segment of the actuator arm and the closure system.

* * * * *